US010002554B2

(12) United States Patent
Bae et al.

(10) Patent No.: US 10,002,554 B2
(45) Date of Patent: Jun. 19, 2018

(54) DISPLAY DEVICE AND METHOD OF DETECTING DETERIORATION OF THE SAME

(71) Applicant: Samsung Display Co., Ltd., Yongin, Gyeonggi-do (KR)

(72) Inventors: Jong-Man Bae, Seoul (KR); Jin-Woo Kim, Hwaseong-si (KR); Byeong-Doo Kang, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 605 days.

(21) Appl. No.: 14/602,937

(22) Filed: Jan. 22, 2015

(65) Prior Publication Data

US 2016/0063905 A1 Mar. 3, 2016

(30) Foreign Application Priority Data

Sep. 3, 2014 (KR) ..... 10-2014-0117283

(51) Int. Cl.

*G09G 3/00* (2006.01)
*G09G 3/32* (2016.01)
*G09G 3/20* (2006.01)

(52) U.S. Cl.

CPC ..... *G09G 3/20* (2013.01); *G09G 2330/021* (2013.01); *G09G 2330/025* (2013.01); (Continued)

(58) Field of Classification Search

CPC ..... G09G 3/20; G09G 3/006; G09G 3/3208; G09G 3/3233; G09G 2330/021; G09G 2330/025; G09G 2330/028; G09G 2330/04; G09G 2330/12; G09G 2320/0295; G09G 2320/043; G09G 2300/0842; G09G 2300/0861

(Continued)

(56) References Cited

U.S. PATENT DOCUMENTS

2009/0261732 A1* 10/2009 Bouchard ..... B60Q 11/00 315/82
2010/0315750 A1 12/2010 Maher et al.

(Continued)

FOREIGN PATENT DOCUMENTS

KR 1020100135187 A 12/2010
KR 1020120020481 A 3/2012

(Continued)

*Primary Examiner* — Thienvu Tran
*Assistant Examiner* — Kevin J Comber
(74) *Attorney, Agent, or Firm* — H.C. Park & Associates, PLC

(57) ABSTRACT

A display device includes a display panel, a power supply unit, a first current measuring unit, and an overcurrent preventing switch. The power supply unit provides a power supply voltage to the display panel. The first current measuring unit is connected to a first path for providing the power supply voltage from the power supply unit to the display panel and measures a first current flowing through the first path. The overcurrent preventing switch is connected in parallel with the first current measuring unit and selectively forms a detour path for the first path according to an amount of the first current such that at least a portion of the first current flows through the detour path.

14 Claims, 4 Drawing Sheets

(52) U.S. Cl.
CPC ... *G09G 2330/028* (2013.01); *G09G 2330/04* (2013.01); *G09G 2330/12* (2013.01)

(58) Field of Classification Search
USPC ..... 361/55
See application file for complete search history.

(56) References Cited

U.S. PATENT DOCUMENTS

| | | | | |
|---|---|---|---|---|
| 2012/0049740 | A1 | 3/2012 | Kang et al. | |
| 2012/0062148 | A1* | 3/2012 | Kim ..... | H05B 33/0815 315/297 |
| 2014/0097685 | A1 | 4/2014 | Jun et al. | |

FOREIGN PATENT DOCUMENTS

| | | | |
|---|---|---|---|
| KR | 1020120026829 | A | 3/2012 |
| KR | 1020140041357 | A | 4/2014 |

* cited by examiner

DISPLAY DEVICE AND METHOD OF DETECTING DETERIORATION OF THE SAME

CLAIM OF PRIORITY

This application claims priority and all the benefits accruing under 35 U.S.C. § 119 to Korean patent Application No. 10-2014-0117283 filed in the Korean Intellectual Property Office ("KIPO") on Sep. 3, 2014, the disclosure of which is hereby incorporated by reference herein in its entirety.

BACKGROUND OF THE INVENTION

Field of the Invention

Example embodiments of the inventive concept relate to electronic devices. More particularly, example embodiments of the inventive concept relate to a display device and a method of detecting deterioration of the display device.

Description of the Related Art

A display device displays an image using a plurality of pixels that emit light. An organic light emitting display device includes the pixel having the organic light emitting diode (OLED). The OLED emits the light of which wavelength corresponds to an organic material included in the OLED. For example, the OLED may include the organic material corresponding to a red color light, a green color light, or a blue color light. The organic light emitting display device displays the image by mixing the light outputted by the organic materials The display panel is deteriorated as driving time passes. Specially, the organic light emitting display panel including the OLED may be deteriorated more quickly than other display panels. In result, an afterimage is occurred by the deterioration of the display panel. Therefore, the display device detects the deterioration degree of the display panel and provides compensated data signals to the pixels according to the deterioration degree. However, a current measuring unit for detecting the deterioration degree can be damaged by an overcurrent.

SUMMARY OF THE INVENTION

Example embodiments provide a display device capable of preventing a damage of a current measuring unit for detecting a deterioration degree of a display panel.

Example embodiments provide a method of detecting deterioration of the display device capable of preventing the damage of the current measuring unit.

According to some example embodiments, a display device may include a display panel, a power supply unit configured to provide a power supply voltage to the display panel, a first current measuring unit connected to a first path for providing the power supply voltage from the power supply unit to the display panel, the first current measuring unit configured to measure a first current flowing through the first path, and an overcurrent preventing switch connected in parallel with the first current measuring unit, the overcurrent preventing switch configured to selectively form a detour path for the first path according to an amount of the first current such that at least a portion of the first current flows through the detour path.

In example embodiments, the overcurrent preventing switch may be turned on when the amount of the first current is greater than a first threshold value.

In example embodiments, the turned-on overcurrent preventing switch may be turned off when the amount of the first current is smaller than a second threshold value that is smaller than the first threshold value.

In example embodiments, the power supply unit may provide the power supply voltage to the display panel via the first path while the display panel displays a test image for detecting a deterioration degree of the display panel.

In example embodiments, the display device may further include a second current measuring unit connected to a second path for providing the power supply voltage from the power supply unit to the display panel, the second current measuring unit configured to measure a second current flowing through the second path.

In example embodiments, the power supply unit may provide the power supply voltage to the display panel via the second path while the display panel displays a normal image.

In example embodiments, the first current measuring unit may include a resistor through which the first current flows and a voltage measuring part configured to measure a voltage difference between both terminals of the resistor.

In example embodiments, the display device may further include a detour control unit configured to generate a switch control signal for controlling a switching operation of the overcurrent preventing switch based on the voltage difference.

In example embodiments, the detour control unit may include an amplifier configured to generate an amplification voltage based on the voltage difference, a comparator configured to generate a comparison voltage by comparing a voltage level of the amplification voltage and at least one of predetermined reference voltage levels, and a level shifter configured to adjust a voltage level of the switch control signal based on the comparison voltage.

In example embodiments, the reference voltage levels may include a first reference voltage level and a second reference voltage level lower than the first reference voltage level. The comparator may be a hysteresis comparator that generates the comparison voltage having a first voltage level when the voltage level of the amplification voltage is higher than the first reference voltage level, and a second voltage level when the voltage level of the amplification voltage is lower than the second reference voltage level.

In example embodiments, the overcurrent preventing switch may include a transistor having a gate electrode to which the switch control signal is applied.

In example embodiments, the level shifter may adjust the voltage level of the switch control signal to turn on the transistor when a voltage level of the comparison voltage is the first voltage level, and adjusts the voltage level of the switch control signal to turn off the transistor when the voltage level of the comparison voltage is the second voltage level.

According to some example embodiments, a display device includes a display panel, a power supply unit configured to provide a power supply voltage to the display panel, a first current measuring unit connected to a first path for providing the power supply voltage from the power supply unit to the display panel, the first current measuring unit configured to measure a first current flowing through the first path, a second current measuring unit connected to a second path for providing the power supply voltage from the power supply unit to the display panel, the second current measuring unit configured to measure a second current flowing through the second path, a first switch connected to the first path, the first switch being turned off when an amount of the first current is greater than a first threshold value, and a second switch connected to the second path, the second switch being turned on when the amount of the first current is greater than the first threshold value.

In example embodiments, the turned-off first switch may be turned on when the amount of the first current is smaller than a second threshold value that is smaller than the first threshold value. The turned-on second switch may be turned off when the amount of the first current is smaller than the second threshold.

In example embodiments, the power supply unit may provide the power supply voltage to the display panel via the first path while the display panel displays a test image for detecting a deterioration degree of the display panel.

In example embodiments, the power supply unit may provide the power supply voltage to the display panel via the second path while the display panel displays a normal image.

In example embodiments, the display device may further include a switch control unit configured to generate a first switch control signal for controlling a first switch operation of the first switch current and a second switch control signal for controlling a second switch operation of the second switch based on the amount of the first current.

According to some example embodiments, a method of detecting deterioration of a display device may include an operation of measuring a first current flowing through a first path for providing a power supply voltage from a power supply unit to a display panel by a first current measuring unit and an operation of selectively forming a detour path for the first path according to an amount of the first current such that at least a part of the first current flows through the detour path.

In example embodiments, the detour path may be controlled using an overcurrent preventing switch connected in parallel with the first current measuring unit.

In example embodiments, the detour path may be controlled using a first switch connected to the first path and a second switch connected to a second path for providing the power supply voltage from the power supply unit to the display panel.

In example embodiments, the selectively forming the detour path may include an operation of connecting the detour path when an amount of the first current is greater than a first threshold value and an operation of disconnecting the detour path when the amount of the first current is smaller than a second threshold value that is smaller than the first threshold value.

Therefore, a display device and a method of detecting deterioration of the display device can prevent a damage of the first current measuring unit for detecting deterioration degree of the display panel by selectively forming a detour path.

BRIEF DESCRIPTION OF THE DRAWINGS

Exemplary embodiments will be described more fully hereinafter with reference to the accompanying drawings, in which various embodiments are shown.

DESCRIPTION OF INVENTION

Exemplary embodiments will be described more fully hereinafter with reference to the accompanying drawings, in which various embodiments are shown.

Figure 1:
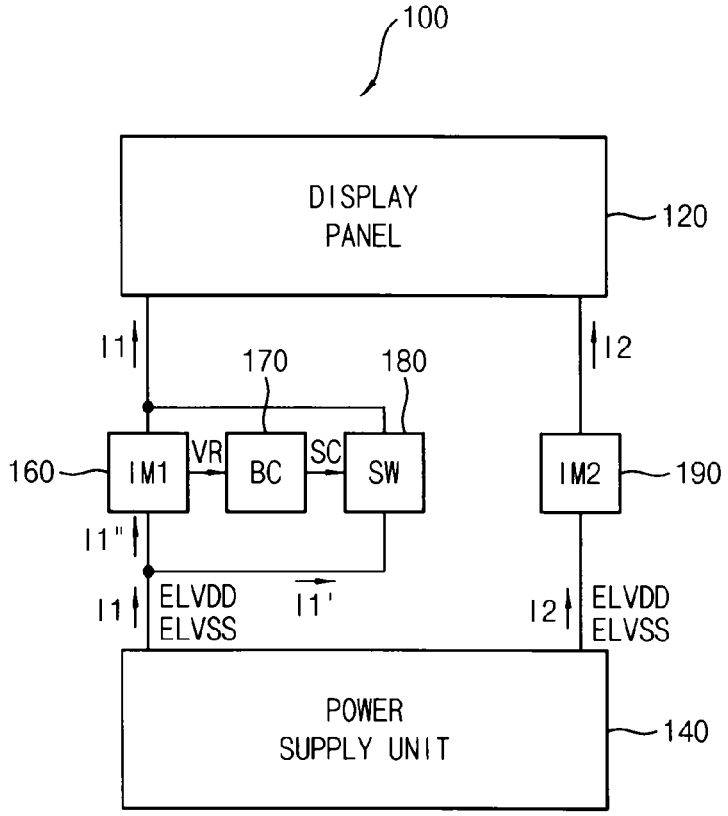
FIG. 1 is a block diagram illustrating a display device according to example embodiments.

FIG. 1 is a block diagram illustrating a display device according to example embodiments.

Referring to FIG. 1, the display device 100 may include a display panel 120, a power supply unit 140, a first current measuring unit 160, and an overcurrent preventing switch 180. In one example embodiment, the display device 100 may further include a detour control unit 170 and a second current measuring unit 190.

The display panel 120 may include a pixel. The pixel may emit the light based on a voltage level of a data signal and voltage levels of power supply voltage ELVDD or ELVSS. For example, in an organic light emitting display device, a driving transistor included in the pixel may generate a driving current based on the voltage level of the data signal and the voltage level of the power supply voltage ELVDD or ELVSS. The OLED included in the pixel may emit the light based on the driving current. In addition, the pixel may include a plurality of sub-pixels. For example, the sub-pixels may emit the light corresponding to three primary colors of light. The sub-pixels may emit the light of which luminance is determined by the data signal provided to the sub-pixels. In result, the pixel may display target color and target luminance by mixing the light emitted by the sub-pixels.

The power supply unit 140 may provide the power supply voltage ELVDD or ELVSS to the display panel 120. In one example embodiment, the power supply unit 140 may provide a high power supply voltage ELVDD. In another example embodiment, the power supply unit 140 may provide a low power supply voltage ELVSS. The display panel 120 may receive a first current I1 via a first path for providing the power supply voltage ELVDD or ELVSS from the power supply unit 140 to the display panel 120. In one example embodiment, the display panel 120 may receive a second current I2 via a second path for providing the power supply voltage ELVDD or ELVSS from the power supply unit 140 to the display panel 120.

In one example embodiment, the power supply unit 140 may provide the power supply voltage ELVDD or ELVSS to the display panel 120 via the first path while the display panel 120 displays a test image for detecting a deterioration degree of the display panel 120. Also, the power supply unit 140 may provide the power supply voltage ELVDD or ELVSS to the display panel 120 via the second path while the display panel 120 displays a normal image.

The first current I1 and the second current I2 may be the driving current of the pixel included in the display panel 120. Therefore, an amount of the first current I1 and an amount of the second current I2 may be substantially the same as an amount of the driving current.

The first current measuring unit 160 may be connected to the first path for providing the power supply voltage ELVDD or ELVSS from the power supply unit 140 to the display panel 120. For example, the first current measuring unit 160 may be connected between the display panel 120 and the power supply unit 140. Generally, an ideal current measuring unit may not have a resistance. Therefore, the ideal first current measuring unit connected between the display panel 120 and the power supply unit 140 may not affect the amount of the first current I1.

In addition, the first current measuring unit 160 may measure the first current I1 flowing through the first path. Therefore, the driving current may be measured while the display panel 120 displays the test image for detecting a deterioration degree of the display panel 120, thereby detecting the deterioration degree of the display panel 120.

Generally, a luminance of the OLED may be decreased by the deterioration of the OLED. The luminance of the OLED may be increased as the driving current increases. The driving current may be decreased by the deterioration of the OLED in spite of that the same voltage level of the data signal is applied to the pixel. Therefore, the first current measuring unit 160 may detect a deterioration degree of the OLED included in the pixel by measuring the first current H.

In one example embodiment, the first current measuring unit 160 may include a resistor and a voltage measuring part. The first current I1 may flow through the resistor. The voltage measuring part may measure a voltage difference VR between both terminals of the resistor using Ohm's law. Hereinafter, the first current measuring unit 160 will be described in detail with reference to the FIG. 2.

The overcurrent preventing switch 180 may be connected in parallel with the first current measuring unit 160. The overcurrent preventing switch 180 may selectively form a detour path (for currents I1, I1', and I1 in FIG. 1) for the first path (for current I1" in FIG. 1) according to the amount of the first current I1 such that at least a portion of the first current I1 flows through the detour path. In one example embodiment, the overcurrent preventing switch 180 may be turned on when the amount of the first current I1 is greater than a first threshold value. The overcurrent preventing switch 180 may be turned on to connect the detour path when the first current I1 is overcurrent that can damage the first current measuring unit 160, thereby preventing a damage of the first current measuring unit 160.

To measure the first current I1, a resistance of the resistor included in the first current measuring unit 160 may be relatively higher than a resistance of a resistor included in the second current measuring unit 190. In result, a voltage difference VR capable of damaging the voltage measuring part included in the first current measuring unit 160 may be easily occurred. When the voltage difference VR is occurred and capable of damaging the voltage measuring part, the overcurrent preventing switch 180 may be turned on to prevent a damage of the voltage measuring part.

In one example embodiment, the overcurrent preventing switch 180 may be turned off when the amount of the first current I1 is smaller than a second threshold value that is smaller than the first threshold value. Therefore, the overcurrent preventing switch 180 may disconnect the detour path when the amount of the first current I1 is smaller than the second threshold value, thereby preventing from frequently performing connection and disconnection operations. In one example embodiment, the overcurrent preventing switch 180 may include a transistor.

The detour control unit 170 may generate a switch control signal SC based on the voltage difference VR. The switch control signal SC may be applied to the overcurrent preventing switch 180. The detour control unit 170 may control a switching operation of the overcurrent preventing switch 180 using the switch control signal SC.

The second current measuring unit 190 may be connected to a second path for providing the power supply voltage ELVDD or ELVSS from the power supply unit 140 to the display panel 120. For example, the second current measuring unit 190 may be connected between the display panel 120 and the power supply unit 140. Generally, the ideal current measuring unit may not have a resistance. Therefore, the ideal second current measuring unit connected between the display panel 120 and the power supply unit 140 may not affect the amount of the second current I2.

In addition, the second current measuring unit 190 may measure the second current I2 flowing through the second path. Therefore, the second current measuring unit 190 may measure the driving current while the display panel 120 displays a normal image. A luminance degradation occurred by decrease of the driving current may be compensated in the display device 100 driven by digital driving technique.

An analog driving technique presents the grayscale based on the luminance of the light emitted by the pixel. However, the digital driving technique presents the grayscale based on the emission time of the light having the same luminance. Therefore, when the driving current is changed, the grayscale of the pixel is not correctly presented in the display device 100 driven by digital driving technique.

Here, the second current measuring unit 190 may measure the second current I2, thereby compensating the change of the driving current. Therefore, the pixel may correctly present the grayscale.

In result, the overcurrent preventing switch 180 may be turned on when the amount of the first current I1 is greater than the first threshold value, thereby forming the detour path for the first path and preventing the damage of the first current measuring unit 160 by the first current I1 when the first current I1 is an overcurrent.

Figure 2:
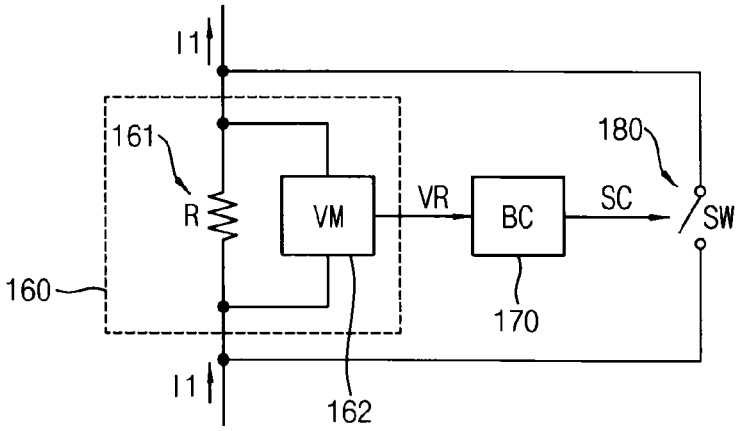
FIG. 2 is a diagram illustrating an example of a first current measuring unit, a detour control unit, and an overcurrent preventing switch included in a display device of FIG. 1.

FIG. 2 is a diagram illustrating an example of a first current measuring unit, a detour control unit, and an overcurrent preventing switch included in a display device of FIG. 1.

Referring to FIG. 2, a display device 100 of FIG. 1 may include a first current measuring unit 160, a detour control unit 170, and an overcurrent preventing switch 180. The first current measuring unit 160 may include a resistor 161 and a voltage measuring part 162.

A first current I1 may flow through the resistor 161. The voltage measuring part 162 may measure a voltage difference VR between both terminals of the resistor 161 using Ohm's law. The voltage measuring part 162 may be connected in parallel with the resistor 161. Generally, an ideal voltage measuring part may have unlimited resistance. Therefore, the ideal voltage measuring part connected in parallel with the resistor 161 may not affect the amount of the first current I1. Here, the voltage measuring part 162 may measure the first current I1 based on the voltage difference VR.

The detour control unit 170 may generate a switch control signal SC based on the voltage difference VR. The switch control signal SC may be applied to the overcurrent preventing switch 180. Specifically, the detour control unit 170 may generate the switch control signal SC using the voltage difference VR between both terminals of the resistor 161. Thus, the detour control unit 170 may control the switching operation of the overcurrent preventing switch 180. In one example embodiment, the detour control unit 170 may receive the voltage difference VR by connecting in parallel with the resistor 161.

In one example embodiment, the detour control unit 170 may include an amplifier, a comparator, and a level shifter.

The amplifier may generate an amplification voltage AxVR based on the voltage difference VR. The comparator may generate a comparison voltage VC by comparing a voltage level of the amplification voltage AxVR and at least one of predetermined reference voltage levels. In one example embodiment, the comparator may generate the comparison voltage VC having a first voltage level when the voltage level of the amplification voltage AxVR is higher than a reference voltage level and generate the comparison voltage VC having a second voltage level when the voltage level of the amplification voltage AxVR is lower than the reference voltage level. In another example embodiment, the comparator may generate the comparison voltage VC having a first voltage level when the voltage level of the amplification voltage AxVR is higher than a first reference voltage level and generate the comparison voltage VC having a second voltage level when the voltage level of the amplification voltage AxVR is lower than a second reference voltage level lower than the first reference voltage level. Thus, the comparator may be a hysteresis comparator. The level shifter may adjust a voltage level of the switch control signal SC based on the comparison voltage VC. In one example embodiment, the level shifter may adjust the voltage level of the switch control signal SC to turn on the transistor when a voltage level of the comparison voltage VC is the first voltage level. The level shifter may adjust the voltage level of the switch control signal SC to turn off the transistor when the voltage level of the comparison voltage VC is the second voltage level. Hereinafter, the detour control unit 170 will be described in detail with reference to the FIG. 3

The overcurrent preventing switch 180 may be connected in parallel with the first current measuring unit 160. The overcurrent preventing switch 180 may selectively form a detour path for the first path according to an amount of the first current I1 such that at least a portion of the first current I1 flows through the detour path. In one example embodiment, the overcurrent preventing switch 180 may be turned on when the amount of the first current I1 is greater than a first threshold value. The overcurrent preventing switch 180 may be turned on to connect the detour path when the first current I1 is overcurrent that can damage the first current measuring unit 160, thereby preventing a damage of the first current measuring unit 160.

When the first current I1 is greater than the first threshold value, the first current measuring unit 160 may be damaged by the first current I1. A first power, consumed while the display panel displays the test image for detecting a deterioration degree of the display panel, may be smaller than a second power consumed while the display panel displays the normal image. Thus, an amount of the first current I1 for displaying the test image may be smaller than an amount of the second current I2 for displaying the normal image.

Therefore, a resistor 161 included in the first current measuring unit 160 may have relatively high resistance to measure the first current I1. In result, the voltage difference VR between both terminals of the resistor 161 may be relatively largely changed according to a change of the first current I1. In addition, the voltage measuring part 162 included in the first current measuring unit 160 may be damaged when the voltage difference VR is greater than predetermined value. Thus, when an amount of the first current I1 is greater than the first threshold value, the voltage difference VR is greater than predetermined value capable of damaging the voltage measuring part 162. Here, the overcurrent preventing switch 180 may be turned on by the switch control signal SC generated by the detour control unit 170, thereby preventing a damage of the voltage measuring part 162.

Figure 3:
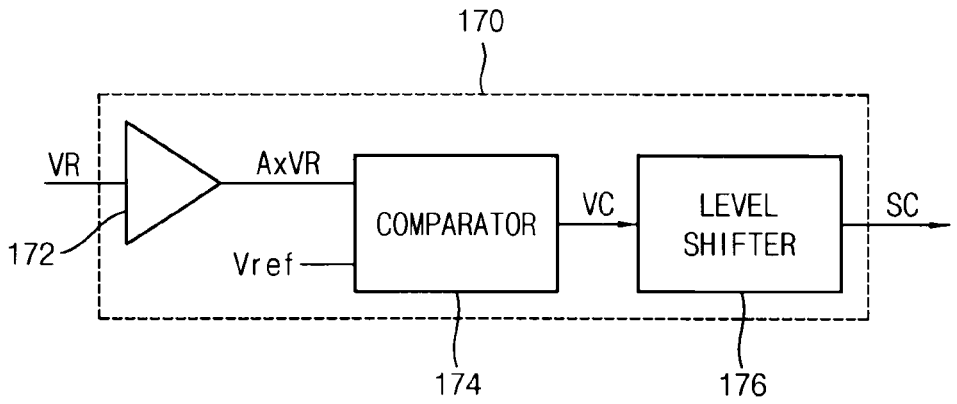
FIG. 3 is a diagram illustrating an example of a detour control unit included in a display device of FIG. 1.

FIG. 3 is a diagram illustrating an example of a detour control unit included in a display device of FIG. 1.

Referring to FIG. 3, the detour control unit 170 may include an amplifier 172, a comparator 174, and a level shifter 176.

The amplifier 172 may generate an amplification voltage AxVR based on the voltage difference VR. Specifically, the amplifier 172 may multiply the voltage gain A by the voltage difference VR to generate the amplification voltage AxVR. The amplifier 172 may provide the generated amplification voltage AxVR to the comparator 174.

The comparator 174 may generate a comparison voltage VC by comparing a voltage level of the amplification voltage AxVR and at least one of predetermined reference voltage levels.

In one example embodiment, the comparator 174 may generate the comparison voltage VC having a first voltage level when the voltage level of the amplification voltage AxVR is higher than a voltage level of a reference voltage Vref. Also, the comparator 174 may generate the comparison voltage VC having a second voltage level when the voltage level of the amplification voltage AxVR is lower than the voltage level of the reference voltage Vref. In another example embodiment, the comparator 174 may generate the comparison voltage VC having the first voltage level when the voltage level of the amplification voltage AxVR is higher than a first reference voltage level. Also, the comparator 174 may generate the comparison voltage VC having the second voltage level when the voltage level of the amplification voltage AxVR is lower than a second reference voltage level lower than the first reference voltage level. Thus, the comparator 174 may be a hysteresis comparator. Hereinafter, the hysteresis comparator will be described in detail with reference to the FIG. 4.

The level shifter 176 may adjust a voltage level of the switch control signal SC based on the comparison voltage VC. In one example embodiment, the overcurrent preventing switch 180 of FIG. 1 may include a transistor having a gate electrode to which the switch control signal SC is applied. The level shifter 176 may adjust the voltage level of the switch control signal SC to turn on the transistor when a voltage level of the comparison voltage VC is the first voltage level. Also, the level shifter 176 may adjust the voltage level of the switch control signal SC to turn off the transistor when the voltage level of the comparison voltage VC is the second voltage level.

Figure 4:
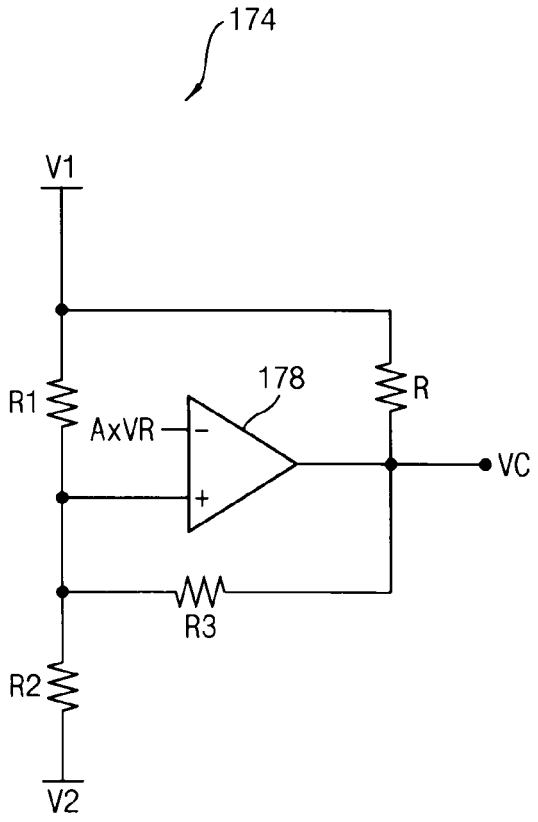
FIG. 4 is a circuit diagram illustrating an example of a comparator included in a detour control unit of FIG. 3.

FIG. 4 is a circuit diagram illustrating an example of a comparator included in a detour control unit of FIG. 3.

Referring to FIG. 4, the comparator 174 may be a hysteresis comparator. The comparator 174 may include an amplifier 178, a first resistor R1, a second resistor R2, a third resistor R3, and a fourth resistor R.

The amplifier 178 may include an inverted signal input terminal to which an amplification voltage AxVR is applied, a non-inverted signal input terminal, and an output terminal. The first resistor R1 may be connected between a first voltage terminal and the non-inverted signal terminal. The second resistor R2 may be connected between the non-inverted signal terminal and a second voltage terminal. The third resistor R3 may be connected between the non-inverted signal terminal and the output terminal. The fourth resistor R may be connected between the first voltage terminal and the output terminal. The output terminal may be connected to the level shifter 176 of FIG. 3.

The comparator 174 may generate the comparison voltage having a first voltage level when a voltage level of the amplification voltage AxVR is higher than a first reference voltage level. The comparator 174 may generate the comparison voltage having a second voltage level when the voltage level of the amplification voltage AxVR is lower than a second reference voltage level lower than the first reference voltage level. Here, the first reference voltage level may be calculated according to [Equation 1] below:

$$V_{ref1} = \frac{R2}{R2 + R1 \parallel R3} \times (V1 - V2) \quad \text{[Equation 1]}$$

Here, Vref1 is the first reference voltage level, R1 is a resistance of the first resistor, R2 is a resistance of the second resistor, R3 is a resistance of the third resistor, V1 is a voltage level of the first voltage applied to the first voltage terminal, and V2 is a voltage level of the second voltage applied to the second voltage terminal.

The second reference voltage level may be calculated according to [Equation 2] below:

$$V_{ref2} = \frac{R2 \parallel R3}{R1 + R2 \parallel R3} \times (V1 - V2) \quad \text{[Equation 2]}$$

Here, Vref2 is the second reference voltage level, R1 is a resistance of the first resistor, R2 is a resistance of the second resistor, R3 is a resistance of the third resistor, V1 is a voltage level of the first voltage applied to the first voltage terminal, and V2 is a voltage level of the second voltage applied to the second voltage terminal.

Figure 5:
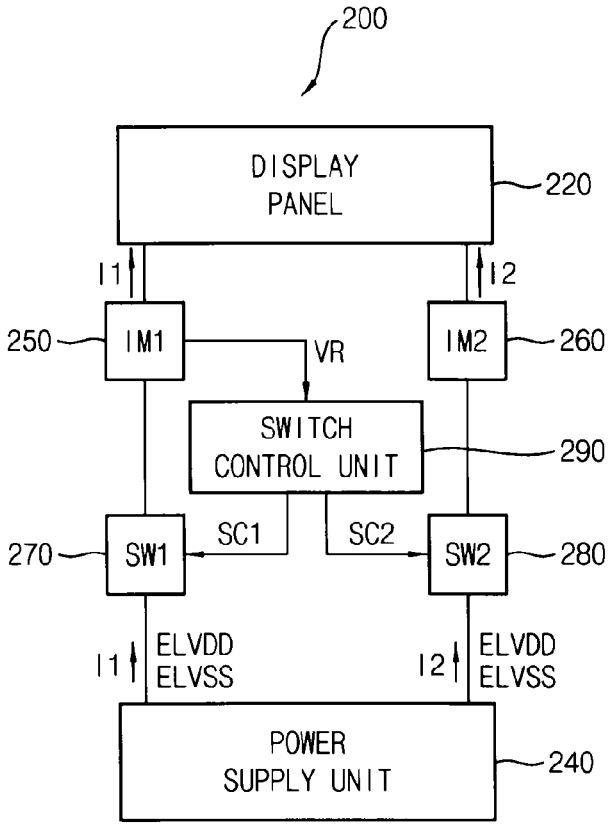
FIG. 5 is a block diagram illustrating a display device according to example embodiments.

FIG. 5 is a block diagram illustrating a display device according to example embodiments.

Referring to FIG. 5, the display device 200 may include a display panel 220, a power supply unit 240, a first current measuring unit 250, a second current measuring unit 260, a first switch 270, and a second switch 280. In one example embodiment, the display device 200 may further include a switch control unit 290.

The display panel 220 may include a pixel. The pixel may emit the light based on a voltage level of a data signal and voltage levels of power supply voltage ELVDD or ELVSS. For example, in an organic light emitting display device, a driving transistor included in the pixel may generate a driving current based on the voltage level of the data signal and the voltage levels of the power supply voltage ELVDD or ELVSS. The OLED included in the pixel may emit the light based on the driving current. In addition, the pixel may include a plurality of sub-pixels. For example, the sub-pixels may emit the light corresponding to three primary colors of light. The sub-pixels may emit the light of which luminance is determined by the data signal provided to the sub-pixels. In result, the pixel may display target color and target luminance by mixing the light emitted by the sub-pixels.

The power supply unit 240 may provide the power supply voltage ELVDD or ELVSS to the display panel 220. In one example embodiment, the power supply unit 240 may provide a high power supply voltage ELVDD. In another example embodiment, the power supply unit 240 may provide a low power supply voltage ELVSS. The display panel 220 may receive a first current I1 via a first path for providing the power supply voltage ELVDD or ELVSS from the power supply unit 240 to the display panel 220. In one example embodiment, the display panel 220 may receive a second current I2 via a second path for providing the power supply voltage ELVDD or ELVSS from the power supply unit 240 to the display panel 220.

In one example embodiment, the power supply unit 240 may provide the power supply voltage ELVDD or ELVSS to the display panel 220 via the first path while the display panel 220 displays a test image for detecting a deterioration degree of the display panel 220. Also, the power supply unit 240 may provide the power supply voltage ELVDD or ELVSS to the display panel 220 via the second path while the display panel 220 displays a normal image.

The first current I1 and the second current I2 may be the driving current of the pixel included in the display panel 220. Therefore, an amount of the first current I1 and an amount of the second current I2 may be substantially the same as an amount of the driving current.

The first current measuring unit 250 the second current measuring unit 260 may be connected to the display panel 220. Generally, an ideal current measuring unit may not have a resistance. Therefore, the ideal first current measuring unit and the ideal second current measuring unit connected the display panel 220 may not affect the amount of the first current I1 and the amount of the second current I2.

The first current measuring unit 250 may be connected to the first path for providing the power supply voltage ELVDD or ELVSS from the power supply unit 240 to the display panel 220. For example, the first current measuring unit 250 may be connected between the display panel 220 and the first switch 270. Generally, the ideal current measuring unit may not have a resistance. Therefore, the ideal first current measuring unit connected between the display panel 220 and the first switch 270 may not affect the amount of the first current I1.

In addition, the first current measuring unit 250 may measure the first current I1 flowing through the first path. Therefore, the driving current may be measured while the display panel 220 displays the test image for detecting a deterioration degree of the display panel 220, thereby detecting the deterioration degree of the display panel 220.

Generally, a luminance of the OLED may be decreased by the deterioration of the OLED. The luminance of the OLED may be increased as the driving current increases. The driving current may be decreased by the deterioration of the OLED in spite of that the same voltage level of the data signal is applied to the pixel. Therefore, the first current measuring unit 250 may detect a deterioration degree of the OLED included in the pixel by measuring the first current I1.

In one example embodiment, the first current measuring unit 250 may include a resistor and a voltage measuring part. The first current I1 may flow through the resistor. The voltage measuring part may measure a voltage difference VR between both terminals of the resistor using Ohm's law. The first current I1 may be measured based on the voltage difference VR.

The second current measuring unit 260 may be connected to a second path for providing the power supply voltage ELVDD or ELVSS from the power supply unit 240 to the display panel 220. For example, the second current measuring unit 260 may be connected between the display panel 220 and the second switch 280. Generally, the ideal current measuring unit may not have a resistance. Therefore, the ideal second current measuring unit connected between the display panel 220 and the second switch 280 may not affect the amount of the second current I2.

In addition, the second current measuring unit 260 may measure the second current I2 flowing through the second path. Therefore, the second current measuring unit 260 may measure the driving current while the display panel 220 displays a normal image. A luminance degradation occurred by decrease of the driving current may be compensated in the display device 200 driven by digital driving technique.

An analog driving technique presents the grayscale based on the luminance of the light emitted by the pixel. However, the digital driving technique presents the grayscale based on the emission time of the light having the same luminance. Therefore, when the driving current is changed, the grayscale of the pixel is not correctly presented in the display device 200 driven by digital driving technique.

Here, the second current measuring unit 260 may measure the second current I2, thereby compensating the change of the driving current. Therefore, the pixel may correctly present the grayscale.

The first switch 270 may be connected to the first path. For example, the first switch 270 may be connected between the first current measuring unit 250 and the power supply unit 240. The first switch 270 may be turned off when an amount of the first current I1 is greater than a first threshold value not to provide the power supply voltage ELVDD or ELVSS to the display panel 220 via the first path. In one example embodiment, the turned-off first switch 270 may be turned on when the amount of the first current I1 is smaller than a second threshold value. The second threshold value may be sufficiently smaller than the first threshold value. Therefore, the first switch 270 may be turned off when the first current I1 greater than the first threshold value flows through the first current measuring unit 250, and the turned-off first switch 270 may be turned on when the first current I1 smaller than the second threshold value flows through the first current measuring unit 250, thereby preventing from frequently performing switching operations of the first switch 270. In one example embodiment, the first switch 270 may include a transistor.

The second switch 280 may be connected to the second path. For example, the second switch 280 may be connected between the second current measuring unit 260 and the power supply unit 240. The second switch 280 may be turned on when the amount of the first current I1 is greater than the first threshold value to provide the power supply voltage ELVDD or ELVSS to the display panel 220 via the second path. In one example embodiment, the turned-on second switch 280 may be turned off when the amount of the first current I1 is smaller than the second threshold. The second threshold value may be sufficiently smaller than the first threshold value. Therefore, the second switch 280 may be turned on when the first current I1 greater than the first threshold value flows through the first current measuring unit 250, and the turned-on second switch 280 may be turned off when the first current I1 smaller than the second threshold value flows through the first current measuring unit 250, thereby preventing from frequently performing switching operations of the second switch 280. In one example embodiment, the second switch 280 may include a transistor.

The switch control unit 290 may generate a first switch control signal SC1 and a second switch control signal SC2 based on the amount of the first current I1.

In one example embodiment, the switch control unit 290 may turn off the first switch 270 and turn on the second switch 280 when the first current I1 greater than the first threshold value flows through the first current measuring unit 250. Specifically, the switch control unit 290 may generate the first switch control signal SC1 for turning off the first switch 270 when the first current I1 greater than the first threshold value flows through the first current measuring unit 250. Also, the switch control unit 290 may generate the second switch control signal SC2 for turning on the second switch 280 when the first current I1 greater than the first threshold value flows through the first current measuring unit 250.

In one example embodiment, the switch control unit 290 may turn on the first switch 270 and turn off the second switch 280 when the first current I1 smaller than the second threshold value flows through the first current measuring unit 250. Specifically, the switch control unit 290 may generate the first switch control signal SC1 for turning on the first switch 270 when the first current I1 smaller than the second threshold value flows through the first current measuring unit 250. Also, the switch control unit 290 may generate the second switch control signal SC2 for turning off the second switch 280 when the first current I1 smaller than the second threshold value flows through the first current measuring unit 250.

In result, when the amount of the first current I1 is greater than the first threshold value, the first switch 270 is turned off and the second switch 280 is turned on, thereby connecting a detour path for the first path to prevent a damage of the first current measuring unit 250 by the first current I1.

Figure 6:
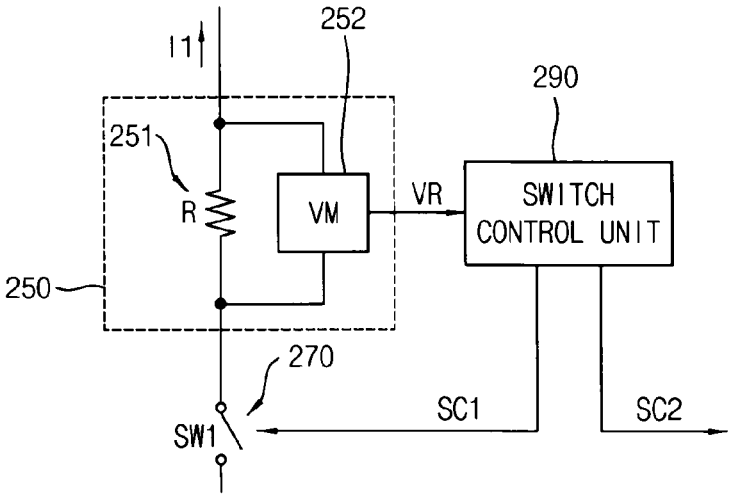
FIG. 6 is a diagram illustrating an example of a first current measuring unit, a first switch, and a switch control unit included in a display device of FIG. 5.

FIG. 6 is a diagram illustrating an example of a first current measuring unit, a first switch, and a switch control unit included in a display device of FIG. 5.

Referring FIG. 6, a display device 200 of FIG. 5 may include a first current measuring unit 250, a switch control unit 290, and a first switch 270. The first current measuring unit 250 may include a resistor 251 and a voltage measuring part 252.

A first current I1 may flow through the resistor 251. The voltage measuring part 252 may measure a voltage difference VR between both terminals of the resistor 251 using Ohm's law. The voltage measuring part 252 may be connected in parallel with the resistor 251. Generally, an ideal voltage measuring part may have unlimited resistance. Therefore, the ideal voltage measuring part connected in parallel with the resistor 251 may not affect the amount of the first current I1. Here, the voltage measuring part 252 may measure the first current I1 based on the voltage difference VR.

The switch control unit 290 may generate a first switch control signal SC1 and a second switch control signal SC2 based on the voltage difference VR. The first switch control signal SC1 may be provided to the first switch 270. The second switch control signal SC2 may be provided to the second switch. Specifically, the switch control unit 290 may generate the first switch control signal SC1 and the second switch control signal SC2 based on the voltage difference VR between both terminals of the resistor 251 included in the first current measuring unit 250. Thus, the switch control unit 290 may control switch operations of the first switch 270 and the second switch using the first switch control signal SC1 and the second switch control signal SC2. In one example embodiment, the switch control unit 290 may be connected in parallel with the resistor 251 and receive the voltage difference VR.

When the first current I1 greater than the first threshold value flows through the first current measuring unit 250, the first current measuring unit 250 may be damaged. Especially, a first power consumed while the display panel displays the test image for detecting a deterioration degree of the display panel may be smaller than a second power consumed while the display panel displays the normal image. Thus, an amount of the first current I1 for displaying the test image may be smaller than an amount of the second current I2 for displaying the normal image.

Therefore, a resistor 251 included in the first current measuring unit 250 may have relatively high resistance to measure the first current I1. In result, the voltage difference VR between both terminals of the resistor 251 may be relatively largely changed according to a change of the first current I1. In addition, the voltage measuring part 252 included in the first current measuring unit 250 may be damaged when the voltage difference VR is greater than predetermined value. Thus, when an amount of the first current I1 is greater than the first threshold value, the voltage difference VR is greater than predetermined value capable of damaging the voltage measuring part 252. Here, the first switch 270 is turned off and the second switch is turned on by the first switch control signal SC1 and the second switch control signal SC2 generated by the switch control unit 290, thereby preventing a damage of the voltage measuring part 252.

Figure 7:
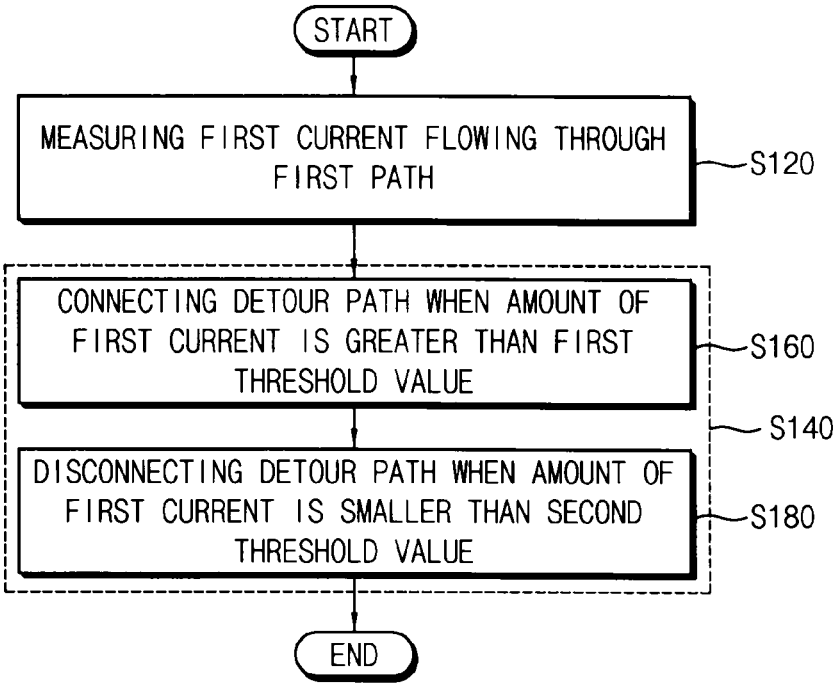
FIG. 7 is a flow chart illustrating a method of detecting deterioration of a display device according to example embodiments.

FIG. 7 is a flow chart illustrating a method of detecting deterioration of a display device according to example embodiments.

Referring to FIG. 7, a method of detecting deterioration of a display device of FIG. 7 may include an operation of measuring a first current flowing through a first path for providing a power supply voltage from a power supply unit to a display panel by a first current measuring unit S120 and an operation of selectively forming a detour path for the first path according to an amount of the first current such that at least a part of the first current flows through the detour path S140. In one example embodiment, the selectively forming the detour path may include an operation of connecting the detour path when an amount of the first current is greater than a first threshold value S160 and an operation of disconnecting the detour path when an amount of first current is smaller than a second threshold value S180. Thus, the detour path may be selectively formed by connecting and disconnection operations according to the amount of the first current.

The first current flowing through the first path may be measured by the first current measuring unit S120.

The power supply unit may provide the power supply voltage to the display panel. Foe example, the power supply unit may provide the power supply voltage to the display panel via the first path while the display panel displays a test image for detecting a deterioration degree of the display panel. Here, the first current may be a driving current of the pixel included in the display panel. Therefore, an amount of the first current may be substantially the same as an amount of the driving current.

The driving current may measured while the display panel displays a test image for detecting a deterioration degree of the display panel by measuring the first current.

Generally, a luminance of the OLED may be decreased by the deterioration of the OLED. The luminance of the OLED may be increased as the driving current increases. The driving current may decrease by the deterioration of the OLED in spite of that the same voltage level of the data signal is applied to the pixel. Therefore, the deterioration degree of the OLED included in the pixel may be detected by measuring the first current.

The detour path for the first path may be selectively formed according to the amount of the first current such that at least a part of the first current flows through the detour path S140.

In one example embodiment, the detour path may be controlled using an overcurrent preventing switch connected in parallel with the first current measuring unit. The overcurrent preventing switch may selectively form the detour path for the first path according to the amount of the first current such that at least a portion of the first current flows through the detour path. The overcurrent preventing switch may be turned on to connect the detour path when the first current is an overcurrent that can damage the first current measuring unit, thereby preventing a damage of the first current measuring unit.

In one example embodiment, the detour path may be controlled using a first switch connected to the first path and a second switch connected to a second path for providing the power supply voltage from the power supply unit to the display panel. Thus, the second path may be used as the detour path. The second current measuring unit may measure the second current flowing through the second path. The driving current may measured while the display panel displays a normal image by measuring the second current. In result, a luminance degradation occurred by decrease of the driving current may be compensated in the display device driven by digital driving technique.

The detour path may be connected when an amount of the first current is greater than the first threshold value S160. The detour path may be connected when the first current is an overcurrent that can damage the first current measuring unit, thereby preventing a damage of the first current measuring unit.

The detour path may be disconnected when an amount of first current is smaller than the second threshold value S180. The second threshold value may be sufficiently smaller than the first threshold value. Therefore, the detour path may be connected when the first current greater than the first threshold value flow through the first current measuring unit and the detour path may be disconnected when the first current smaller than the second threshold value flow through the first current measuring unit 250, thereby preventing from frequently performing connection and disconnection operations.

In result, the detour path may be formed when the first current is greater than the first threshold value to prevent the damage of the first current measuring unit by the first current.

The present inventive concept may be applied to an electronic device having a display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. For example, although the example embodiments describe that the comparator is a hysteresis comparator including an amplifier and first through fourth resistors, the comparator also can be implemented as various circuits. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel;

a power supply configured to provide a power supply voltage to the display panel;

a first detector configured to measure current on a first path between the power supply and the display panel in association with display, via the display panel, of a test image for detection of a deterioration degree of the display panel, the power supply being configured to provide, via the first path, the power supply voltage to the display panel in association with the display of the test image; and a switch connected in parallel with the first detector, the switch being configured to selectively form a detour path for the first path according to an amount of the first current, the detour path being configured to draw at least a portion of the first current from the first path.

2. The display device of claim 1, wherein the detour path is formed in response to the amount of the first current being greater than a first threshold value.

3. The display device of claim 2, wherein the detour path is broken in response to the amount of the first current being smaller than a second threshold value, the second threshold value being smaller than the first threshold value.

4. The display device of claim 1, further comprising:

a second detector configured to measure current on a second path between the power supply and the display panel, the second path being different from the first path.

5. The display device of claim 4, wherein:

the display panel is configured to display a normal image; and the power supply is configured to provide, via the second path, the power supply voltage to the display panel in association with display of the normal image.

6. The display device of claim 1, wherein:

the first detector comprises a resistor configured to receive the first current; and the first detector is configured to measure a voltage difference between terminals of the resistor.

7. The display device of claim 6, further comprising:

a signal generator configured to generate a control signal to control a switching operation of the switch based on the voltage difference.

8. A display device comprising:

a display panel;

a power supply configured to provide a power supply voltage to the display panel;

a first detector configured to measure current on a first path between the power supply and the display panel, the power supply being configured to provide, via the first path, the power supply voltage to the display panel, the first detector comprising a resistor configured to receive the first current, the first detector being configured to measure a voltage difference between terminals of the resistor;

a switch connected in parallel with the first detector, the switch being configured to selectively form a detour path for the first path according to an amount of the first current, the detour path being configured to draw at least a portion of the first current from the first path; and a signal generator configured to generate a control signal to control a switching operation of the switch based on the voltage difference, wherein the signal generator comprises:

an amplifier configured to generate an amplification voltage based on the voltage difference;

a comparator configured to generate a comparison voltage via comparison of a voltage level of the amplification voltage and at least one determined reference voltage level among determined reference voltage levels; and a level shifter configured to adjust a voltage level of the control signal based on the comparison voltage.

9. The display device of claim 8, wherein:

the determined reference voltage levels comprise a first determined reference voltage level and a second determined reference voltage level, the second determined reference voltage level being lower than the first determined reference voltage level; and the comparator is a hysteresis comparator configured to:

generate the comparison voltage having a first voltage level in response to the voltage level of the amplification voltage being higher than the first determined reference voltage level; and generate the comparison voltage having a second voltage level in response to the voltage level of the amplification voltage being lower than the second determined reference voltage level.

10. The display device of claim 9, wherein:

the switch comprises a transistor, the transistor comprising a gate electrode configured to receive the control signal; and the level shifter is configured to:

adjust the voltage level of the control signal to turn on the transistor in response to a voltage level of the comparison voltage being the first voltage level; and adjust the voltage level of the control signal to turn off the transistor in response to the voltage level of the comparison voltage being the second voltage level.

11. A method of detecting deterioration of a display panel, the method comprising:

causing, at least in part, the display panel to display a test image for detection of the deterioration utilizing a power supply voltage;

causing, at least in part, a first current flowing through a first path carrying the power supply voltage to the display panel to be measured while the display panel displays the test image; and causing, least in part, a detour path for the first path to be selectively formed according to an amount of the first current such that at least a portion of the first current flows through the detour path.

12. The method of claim 11, wherein:

a first detector is utilized to measure the first current on the first path; and the detour path is selectively formed using a switch connected in parallel with the first detector.

13. The method of claim 11, wherein the detour path is selectively formed using a first switch connected to the first path and a second switch connected to a second path configured to provide the power supply voltage to the display panel, the second path being different from the first path.

14. The method of claim 11, wherein selectively forming the detour path comprises:

causing, at least in part, the detour path to be connected in response to an amount of the first current being greater than a first threshold value; and causing, at least in part, the detour path to be disconnected in response to the amount of the first current being smaller than a second threshold value, the second threshold value being smaller than the first threshold value.

* * * * *